US005441329A

United States Patent [19]

Janisch

[11] Patent Number: 5,441,329

[45] Date of Patent: Aug. 15, 1995

[54] ROTATABLE SEAT

[75] Inventor: Klaus Janisch, Isny, Germany

[73] Assignee: Schmidt & Lenhardt GmbH & Co. oHG, Isny, Germany

[21] Appl. No.: 205,943

[22] Filed: Mar. 2, 1994

[30] Foreign Application Priority Data

Mar. 16, 1993 [EP] European Pat. Off. ..... 93104199

[51] Int. Cl.[6] ..... A47C 3/00; A47C 15/00

[52] U.S. Cl. ..... 297/344.21; 297/240; 297/256.12; 297/337; 248/349

[58] Field of Search ..... 297/344.21, 240, 256.12, 297/337; 248/345.1, 349

[56] References Cited

U.S. PATENT DOCUMENTS 3,232,662 2/1966 Graves ..... 297/240
4,034,947 7/1977 Geisel ..... 297/240
4,969,290 11/1990 Skoretz ..... 298/349 X
5,000,513 3/1991 Schmidt ..... 297/240
5,149,043 9/1992 Grundmann ..... 248/349 X

*Primary Examiner*—Laurie K. Cranmer
*Assistant Examiner*—Anthony Barfield
*Attorney, Agent, or Firm*—Notaro & Michalos

[57] ABSTRACT

Pivot-mounted on a bottom plate (12) is a top plate (14) which supports an upholstery pad (16), the latter being secured by a retaining ring (18) around the circumference of said top plate (14). The top plate (14) has an outer rim with a polygonal contour so that the retaining ring (18) only engages under said top plate (14) at the polygon corners. This gives rise to a number of clamping zones arranged at intervals around the circumference, between which there are permanent cavities. The retaining ring (18) can thus be easily removed, by local deformation, from the top plate (14) to enable the rotatable seat (10) to be cleaned.

10 Claims, 3 Drawing Sheets

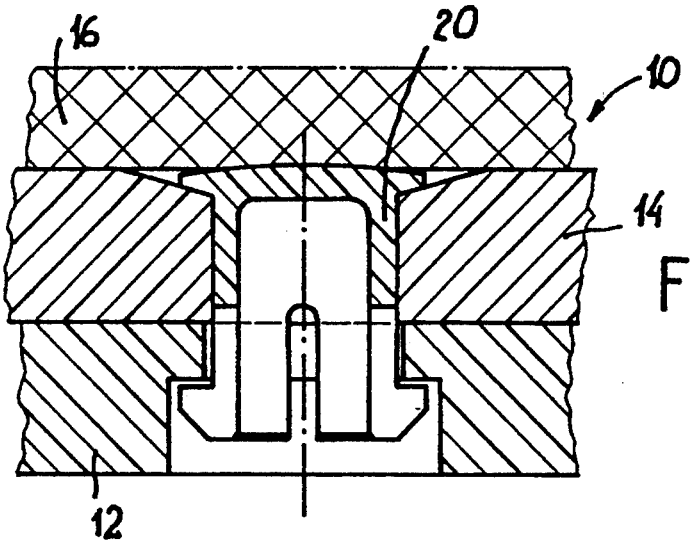
FIG.3
FIG.5
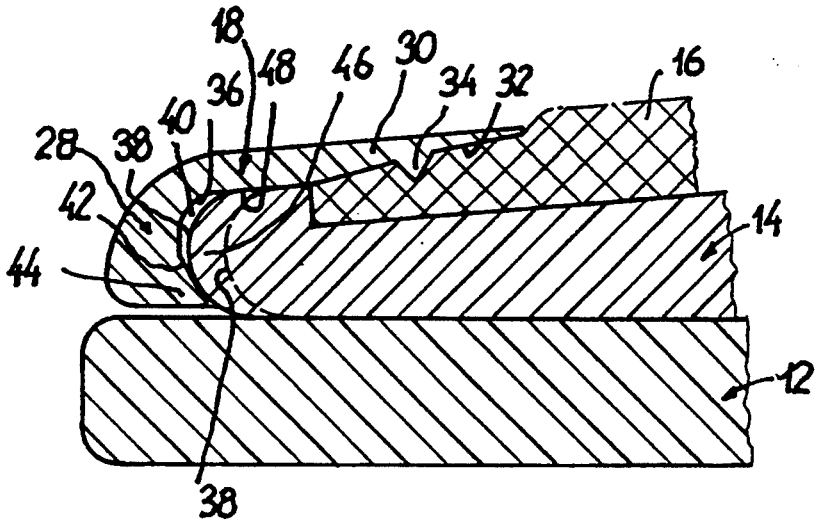

ROTATABLE SEAT

BACKGROUND TO THE INVENTION

The invention concerns a rotatable disc arrangement as a seating surface for physically handicapped people, with a bottom plate, a top plate pivot mounted to this, an upholstery pad centrally arranged on said top plate, and a removable, circular-contoured retaining ring which is attached to the top plate and engages over both the circumferential rim of the upholstery pad and the outer rim of the top plate.

Such a rotatable seat is disclosed in EP-B-0364746. The retaining ring in this case comprises a number of circumferentially adjacent individual ring segments which feature at their bottom latching pins which engage in, and can be disengaged from, corresponding holes in the rotatable top plate. A retaining ring manufactured in one piece would give rise to fitting problems because the top plate, owing to the requisite sliding properties, must consist of a plastics material other than that of the retaining ring, and owing to the different temperature expansion coefficients, would cause fitting deficiencies in respect of the requisite precise engagement of the retaining ring over the top plate.

SUMMARY OF THE INVENTION

The invention is based on the technical problem of improving the rotatable seat of the above-mentioned species by applying a single-piece retaining ring while at the same time avoiding any fitting problems between the retaining ring and top plate, and of simplifying operations in the assembly and disassembly of the retaining ring, without adversely affecting the retention of the upholstery pad on the top plate.

This problem is solved with a rotatable seat of the species indicated above in that the outer rim of the top plate exhibits a regular polygonal contour with a number of rim elements of the same length which are at least approximately straight-lined in nature, and that the retaining ring is manufactured as a single piece, exhibiting an outer annulus which, in its axial section, is hook-shaped and elastically deformable, which retaining ring engages around the top plate at least at the transitions between each pair of adjacent rim elements, and at these transitions is securely located against the outer rim of the top plate.

Thanks to the polygonal contour of the outer rim of the top plate, the retaining ring requires only a very small degree of elastic deformability, because on mounting the retaining ring, its outer annulus is pressed over a few corners of the polygonal outer rim of the top plate, enabling the retaining ring to deform in the manner of a sinew in the regions adjacent to these polygonal corners, resulting in a local increase in diameter of the retaining ring in the area of one or several adjacent corners of the top plate.

The corners between each pair of at least approximately straight-lined rim elements of the top plate are preferably rounded.

One development and embodiment of the invention is that the contour of the axial section of the outer rim of the top plate is at least approximately semicircular in shape. Furthermore, the outer annulus of the retaining ring is preferably designed with a clamping surface which tapers towards the bottom plane of the retaining ring. This clamping surface engages at the rounded corner areas of the polygon in the bottom half of the outer rim of the top plate, with the retaining ring being directly supported at the top by the upper surface of the top plate. The dimension between this support surface of the retaining ring and its clamping surface is slightly smaller than the distance between the corresponding contact surfaces of the top plate, with the result that a certain deformation of the outer annulus of the retaining ring occurs when this is mounted on the top plate. The retaining ring is thus stressed both in the radial and in the axial directions on the top plate, with the result that the upholstery pad is held with absolute firmness on the top plate. Nevertheless, it remains very easy to dismantle the rotatable seat for cleaning purposes because all that is required is an axial force applied to the outer annulus of the retaining ring to exert a lift-off action, an action which for example can be performed using two fingers. With this axial force and the cavity spaces located between the corners of the polygon and between the retaining ring and the top plate, it is possible for the retaining ring to stretch between two corners of the polygon in the manner of a sinew, resulting in an increase in diameter of the retaining ring in the area of the polygon corners, enabling the retaining ring to be lifted from the top plate with ease.

Finally, a further development of the invention entails the outer annulus of the retaining ring, hook-shaped in its axial section, exhibiting a circumferential lip which engages under the outer rim of the top plate, this being of a convex rounded cross-sectional shape, said lip being located at this top plate outer rim under a preload such that it is at least approximately linear in shape. This clamping linear contact between the circumferential lip of the retaining ring and the top plate is advantageous both for the retaining effect and for easy assembly and disassembly of the retaining ring.

The inner annulus of the retaining ring preferably exhibits a regular cross-sectional, radially inward-going taper. The inner end of this inner annulus is then still located below the surface of the upholstery pad in its non-compressed region. On this inner annulus of the retaining ring is provided at the inner end a circumferential rib which penetrates into the upholstery pad, said rib improving retention of the upholstery pad on the top plate. This circumferential rib may be interrupted at circumferential intervals.

BRIEF DESCRIPTION OF THE DRAWINGS

The invention is described in the following in greater detail on the basis of the drawing which represents one embodiment, wherein FIG. 3 shows an enlarged axial cross section of the rotatable seat in the area of a central bearing, FIG. 5 shows a cross-sectional view along the line 5—5 indicated in FIG. 4.

DETAILED DESCRIPTION

Figure 1:
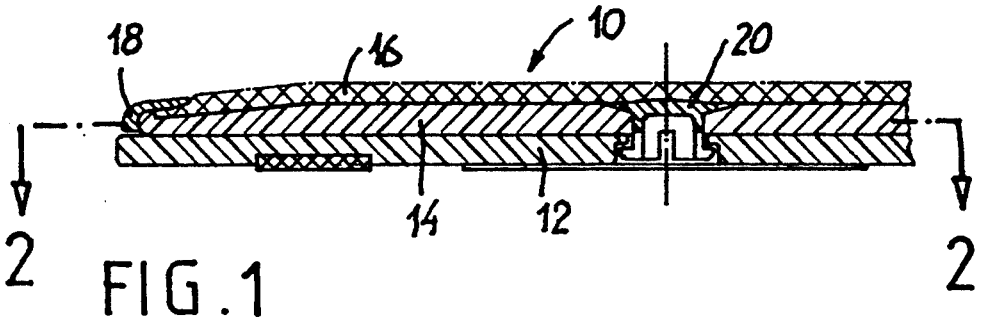
FIG. 1 shows an axial cross section through the new rotatable seat.
Figure 2:
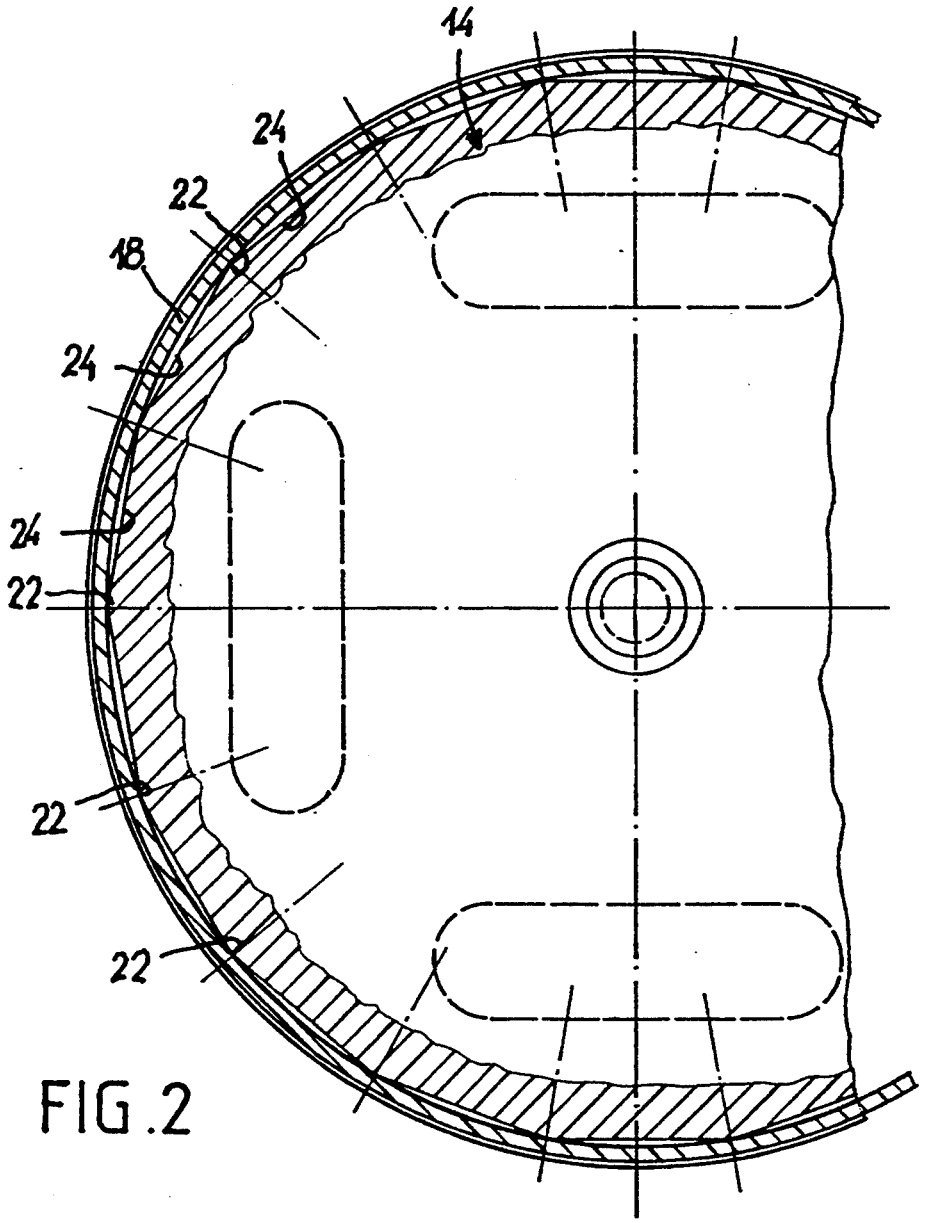
FIG. 2 shows a radial cross section along the line 2—2 of the rotatable seat according to FIG. 1.

The rotatable seat 10 exhibits a bottom plate 12, a top plate 14, a soft, compressible upholstery pad 16, and a retaining ring 18. The bottom plate 12 and the top plate 14 each have a central bore with that of the bottom plate being of stepped design. Plates 12, 14 are interconnected by a central clip 20 which features tab springs at the bottom which engage under an annular shoulder in the stepped bore of bottom plate 12. The top plate can be lifted from the bottom plate by radial inward movement of the tab springs of the central clip 20. Subsequent re-assembly merely requires alignment of the two bores of the bottom plate and top plate, after which the central clip 20 is inserted axially. Its tab springs are automatically deflected inward, and then engage automatically at the annular shoulder of the bottom plate 12. Assembly and disassembly can thus be performed quickly without the need for tools.

The top plate 14 has a novel outer contour exhibiting at equal angular intervals eighteen rounded corners 22 between which, in each case, a straight-lined rim element 24 extends. The top plate 14 is thus of polygonal design at its external circumference.

The retaining ring 18 is rotationally symmetrical in design, that is to say it is of a circular contour. Its inner surface is in intimate contact with the top plate 14 solely at the transitions 22 between, in each case, two straight-lined rim elements 24 of said top plate 14, while between in each case two such transitions 22, which in fact take the form of rounded corners of a polygon, there remains a segmental gap 26, the gap width of which at the centre of the straight-lined rim elements 24 is at its largest, decreasing towards both ends continuously to a value of zero in the area of the transitions 22.

Figure 4:
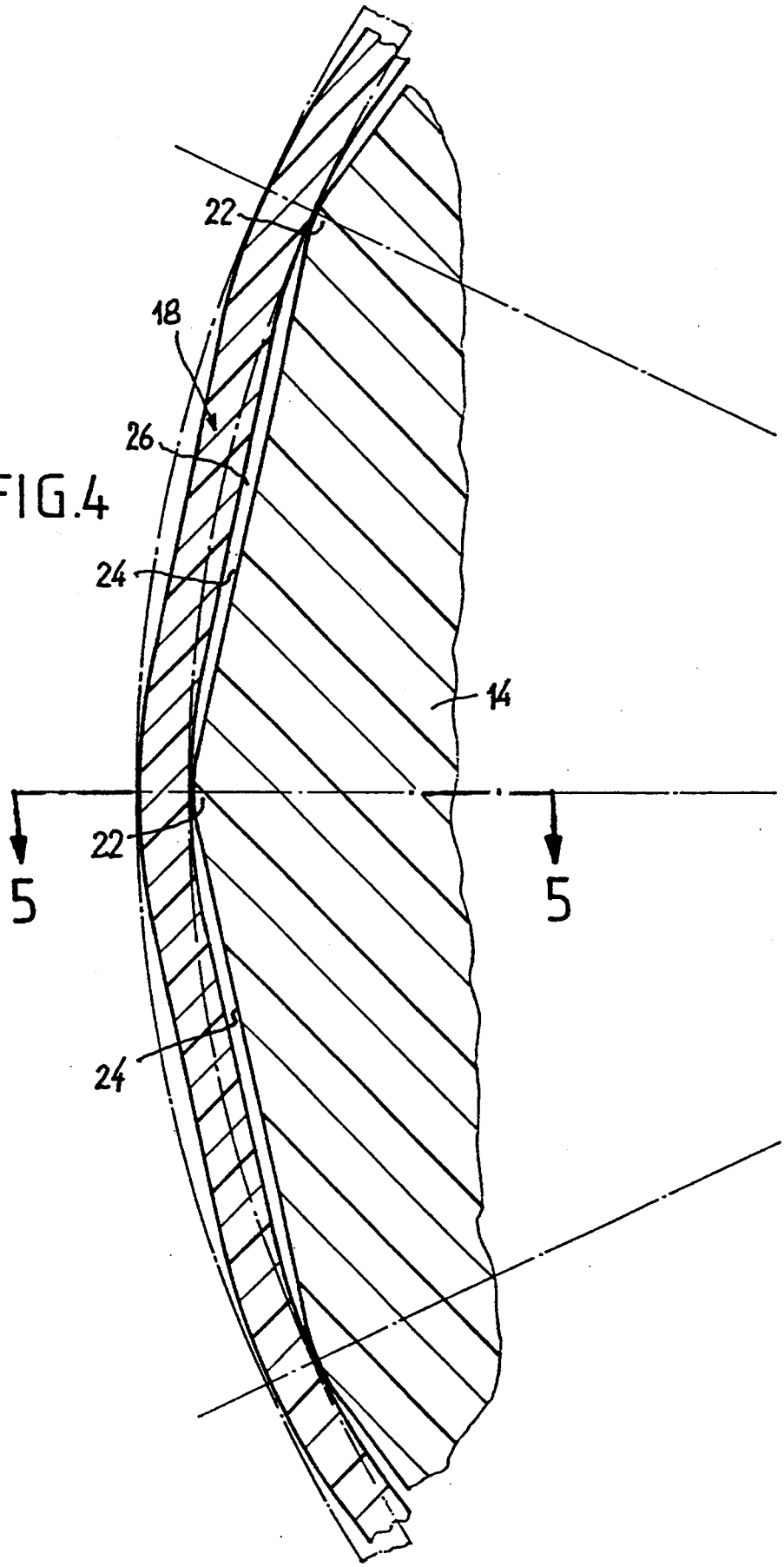
FIG. 4 shows an enlarged cross section similar to that in FIG. 2, but with depiction of a circumferential section of the retaining ring during pressure application of said retaining ring onto the top plate of the rotatable seat.

The combination of an outer annulus of circular contour in the case of the retaining ring 18, and an outer rim of a polygonal contour in the case of the top plate 14 enables the retaining ring 18 to be constructed with only a small degree of elastic deformability such that it is nevertheless easy to clamp onto the top plate 14 and to remove again when required. In order to lift off the retaining ring 18, all that is required is an axial lifting force applied to the outer annulus of the retaining ring 18 at any point around its circumference. The retaining ring 18 then deforms from the circular shape shown by the broken line in FIG. 4 and flattens in the area of the straight-lined rim elements 24 of the top plate 14 in a manner similar to that of a sinew, with an increase in diameter occurring in the area of the transitions 22 (polygon corners), so that the section of the outer annulus of the retaining ring 18 engaged under the top plate 14 is shifted towards the outside and released from the top plate 14.

As is apparent from FIG. 5, the top plate 14 exhibits an axial cross section of a convex rounded contour which here is of semicircular design. The diameter of the top plate 14 is thus at its greatest at mid-height and decreases towards the top and bottom. The diameter decrease in the bottom half of the top plate 14 is important for enabling the retaining ring 18 to engage under the top plate. The retaining ring 18 features a hook-shaped outer annulus 28 and an inner annulus 30 overlapping on the upholstery pad 16, which inner annulus 30 exhibits a tapered upward-pointing inner surface 32 at which a circumferential rib 34 is formed, which rib 34 penetrates in positive locking fashion into the upholstery pad 16. The thickness of the inner annulus 30 decreases continuously in the radial inward-going direction. The cross section of the inner annulus 30 is essentially triangular. The outer annulus 28 of the retaining ring 18 exhibits in its axial section an inner surface 36 which is rounded at the top and which, together with the convex outer surface 38 of the top plate 14, bounds a crescent-shaped cavity 40. The rounded inner surface 36 in the axial cross section of the outer annulus 28 of the retaining ring 18 blends into a tapered clamping surface 42 which terminates at the bottom end of the retaining ring outer annulus 28. Together with the bottom surface of the outer annulus 28, this clamping surface 42 forms a circumferential lip 44 which engages under the outer rim 46 of the top plate 14.

The retaining ring 18 is not in intimate contact with the top plate 14 along the entire circumference of the outer rim 46; rather, intimate contact only occurs in the area of the transitions 22 between each pair of straight-lined rim elements 24 of the top plate 14. Between the inner annulus 30 and the outer annulus 28 of the retaining ring 18 is an inside support surface 48 which rests around the circumference of said retaining ring 18 on a complementary flat annular surface of the top plate 14. The distance between this supporting surface 48 and the tapered clamping surface 42 at the bottom lip 44 of the retaining ring 18 is somewhat smaller in dimension than the corresponding distance of the mating surfaces of the top plate 14, so that in the as-assembled condition, the lip 44 of the retaining ring 18 undergoes a small degree of deformation, as a result of which the retaining ring 18 is clamped firmly both in the radial direction and also in the axial direction on the top plate 14. The circumferential lip 44 ensures that the support surface 48 of the retaining ring is pulled axially against the annular surface of the top plate 14.

FIG. 5 shows as a broken line the contour of the outer rim 46 at the centre of the straight-lined rim element 24 of the top plate 14. In this area, the outer annulus 28 of the retaining ring 18 does not engage under the top plate 14.

Thanks to the segmental gaps 26 between the straight-lined rim elements 24 of the top plate 14, and the circular-contoured retaining ring 18, said retaining ring 18 can be dislodged from the top plate 14 with no more than a small amount of finger pressure. In order to achieve this, the fingers are placed between the retaining ring 18 and the bottom plate 12, and the retaining ring 18 is then pushed anywhere around its circumference away from the bottom plate 12. As the clamping contact between the retaining ring 18 and the top plate 14 only exists within a small section of the circumference between the transitions 22, the outer annulus 28 of the retaining ring 18 deforms on both sides adjacent to this clamping zone, said circular-contoured outer annulus 28 being stretched in the manner of a sinew (FIG. 4) with the width of the gap 26 decreasing in the process. This causes an increase in the diameter of the outer annulus 28 in the area of the transitions 22, and the circumferential lip 44 is dislodged in this area from the outer rim 46 of the top plate 14. The retaining ring 18 can then be simply rotated upward and away from the top plate 14.

I claim:

1. Rotatable disc arrangement as a seating surface for physically handicapped people, with a bottom plate, a top plate with an outer rim, the top plate being pivotally mounted to the bottom plate, an upholstery pad with a circumferential rim, centrally arrayed on said top plate, and a removable, circular-contoured retaining ring which is attached to the top plate and engages over both the circumferential rim of the upholstery pad and the outer rim of the top plate, characterized in that the outer rim of the top plate has a regular polygonal circumferential contour with a plurality of rim elements of the same length which are substantially straight-lined in nature, and with a transition between each pair of adjacent rim elements, and that the retaining ring is manufactured as a single piece having an outer annulus which, in it axial section, is hook-shaped and elastically deformable, which retaining ring engages around the top plate at least at each transition between each pair of adjacent rim elements, and at these transitions is securely located against the outer rim of the top plate.

2. Rotatable seat according to claim 1, characterised in that the transitions are corners (22) formed between each pair of rim elements (24) of the top plate (14) the corners being rounded.

3. Rotatable seat according to claim 1, characterised in that the outer annulus (28) of the retaining ring (18) is in contact with a number of areas (22) arranged at intervals around the outer rim of the top plate (14), and that between each pair of such contact areas (22) is formed a gap (26) between the retaining ring (18) and the top plate (14).

4. Rotatable seat according to claim 3, characterised in that the width of the gap (26) changes continuously in a circumferential direction around the outer rim.

5. Rotatable seat according to claim 1, characterised in that the contour of an axial cross section of the outer rim (46) of the top plate (14) is shaped in to be substantially the form of a semicircle.

6. Rotatable seat according to claim 1, characterised in that the outer annulus (28) of the retaining ring (18) has a clamping surface (42) tapering towards the bottom plane of the retaining ring (18).

7. Rotatable seat according to claim 1, characterised in that the outer annulus (28) of the retaining ring (18), having an axial cross section in the shape of a hook, exhibits a circumferential lip (44) which engages under the outer rim (46) of the top plate (14), said outer rim (46) having a convex rounded cross section, which lip (44) being located under preload against said top plate (14) in substantially linear contact pattern.

8. Rotatable seat according to claim 1, characterized in that the retaining ring (18), has an inner annulus (30) overlapping the upholstery pad (16), the retaining ring having an inner support surface (48) which is supported on an upper complementary mating surface of the top plate (14).

9. Rotatable seat according to claim 1, characterized in that the retaining ring (18) has an inner annulus (30) overlapping the upholstery pad (16) and having an inner surface with circumferential rib (34) which penetrates into said upholstery pad (16).

10. Rotatable seat according to claim 1, characterized in that the retaining ring (18) has an inner annulus with a cross section which continuously tapers radially inwardly of the outer rim of the top plate.

* * * * *